US005586946A

United States Patent [19]

Haber et al.

[11] Patent Number: 5,586,946

[45] Date of Patent: Dec. 24, 1996

[54] GOLF CLUB HAVING A SEGMENTED, VARIABLE POSITION GRIP ASSEMBLY

[75] Inventors: Terry M. Haber, El Toro; William H. Smedley, Lake Elsinore; Clark B. Foster, Laguna Niguel, all of Calif.

[73] Assignee: Habley Medical Technology Corporation, Lake Forrest, Calif.

[21] Appl. No.: 537,129

[22] Filed: Sep. 29, 1995

[51] Int. Cl.[6] ..... A63B 69/36; A63B 53/14

[52] U.S. Cl. ..... 473/295

[58] Field of Search ..... 273/81 R, 81 C, 273/81 B, 81.4, 187.5, 26 B, 75, 67 R, 67 DB, 72 R, 81.2; 473/295

[56] References Cited

U.S. PATENT DOCUMENTS

| | | | |
|---|---|---|---|
| 581,331 | 4/1897 | Brewster | 273/81 B |
| 1,305,952 | 6/1919 | Suesman | 273/81 C |
| 1,544,226 | 6/1925 | De Bus | 273/81 C |
| 1,613,360 | 1/1927 | Rigby | 273/81.2 |
| 2,225,839 | 12/1940 | Moore | 273/81 C |
| 2,876,010 | 3/1959 | Hugman | 273/81 B |
| 3,804,413 | 4/1974 | Hrivnak | 273/81 C |
| 3,834,714 | 9/1974 | Smolinski | 273/81 C |
| 4,365,807 | 12/1982 | Melby | 273/81 B |
| 5,413,339 | 5/1995 | Martin | 273/81 C |

*Primary Examiner*—Sebastiano Passaniti
*Attorney, Agent, or Firm*—Hawes, Fischer & Dickinson

[57] ABSTRACT

Disclosed is a golf club having a shaft, a club head located at end of the shaft and a segmented, variable position grip assembly surrounding the opposite end of the shaft. The grip assembly includes an elliptical upper grip member and an elliptical lower grip member. The upper and lower grip members surround the shaft and are adapted to be selectively rotated relative to one another around the shaft to assume locations that enable the golfer to grasp the club in an optimal and consistent manner so that the club head will strike the golf ball at the same angle during successive strokes. The upper and lower grip members are coupled to each other and to the shaft by the teeth of respective spline sets that are moved into detachable locking engagement. A locking collar surrounds the shaft and slides axially thereallong into engagement with the grip assembly to prevent the rotation of the upper and lower grip members around the shaft when the golf club is played.

20 Claims, 4 Drawing Sheets

GOLF CLUB HAVING A SEGMENTED, VARIABLE POSITION GRIP ASSEMBLY

BACKGROUND OF THE INVENTION

1. Field of the Invention

This invention relates to a golf club having upper and lower elliptically shaped grip members that are adapted to be rotated relative to one another and locked in predetermined positions around the golf club shaft to enable a golfer to grasp the club in a consistent and optimum manner during play.

2. Background Art

As will be known to those who play the game of golf, the traditional golf club includes a wood or metal club head affixed to one end of an elongated, cylindrical shaft. A grip is uniformly wound around the opposite end of the shaft to enable the golfer to reliably grasp the club during play. A hand-over-hand approach is universally adopted by golfers for grasping the golf club. That is to say, the golfer's hands are wrapped around the grip such that one hand is located in axial alignment with the other hand in a direction corresponding to the longitudinal axis of the shaft.

In a majority of golf shots, the golfer's hands are rotated relative to one another along the grip. Thus, the golfer's wrists are separated by an angle, the magnitude of which is determined by the habits of the golfer and the particular club to be played in accordance with the conditions of the golf course. Because the shaft of the golf club and the grip wound thereover are continuously cylindrical, there is no easy way for the golfer to be certain that his hands are constantly rotated to the desired alignment each time that a particular club is played. Therefore, the golfer may not be able to have the head of the club consistently strike his golf ball at the same angle as a consequence of his hands not always assuming optimal positions around the grip for successive golf strokes during which the club is used.

It would therefore be desirable to overcome these problems inherent in a conventional golf club by means of a golf club having a pair of non-cylindrical grip members that can be selectively rotated relative to one another and locked in positions around the shaft to enable the golfer to grip and play the club in a consistent and optimal manner.

SUMMARY OF THE INVENTION

Briefly, and in general terms, a golf club is disclosed having an elongated cylindrical shaft and a conventional wood or metal club head connected to a first end of the shaft. A segmented, variable position grip assembly surrounds the opposite, second end of the shaft. The grip assembly includes an upper grip member and a lower grip member. Each of the upper and lower grip members is characterized by an elliptically-shaped cross-section and a longitudinally extending cylindrical channel to receive the shaft therethrough, whereby the grip members are rotatable relative to one another around the shaft.

Located between the upper and lower grip members is a first cylindrical insert having a peripheral spline set extending around the interior thereof. The first insert is received by a receptacle formed at the front end of the upper grip member. A cylindrical neck having a peripheral spline set extending around the exterior thereof projects from the rear end of the lower grip member. In the assembled relationship, the teeth of the respective spline sets from the first insert and the neck of the lower grip member are mated in interlocking engagement, whereby to couple the upper and lower grip members to one another. A second cylindrical insert having a peripheral spline set extending around the interior thereof is received by a receptacle formed at the rear end of the upper grip member. An end cap that is affixed to the first end of the shaft has a peripheral spline set extending around the front end thereof. In the assembled relationship, the end cap is received by the receptacle at the rear end of the upper grip member behind the second insert, such that the teeth of the respective spline sets from the end cap and the second insert are mated in interlocking engagement, whereby to couple the end cap to the upper grip member.

A series of screw threads spirals around the shaft near the second end thereof. A hollow locking collar having a complementary set of screw threads surrounds the shaft and is releasably locked thereagainst in axial alignment with the upper and lower grip members.

In operation, the hollow locking collar is initially secured against the shaft to hold the upper and lower grip members tightly together. In this case, the upper and lower grip members are coupled to one another and to the shaft by way of the end cap and, therefore, the grip members can not be rotated around the shaft. To selectively adjust the grip assembly, the golfer rotates the locking collar in a counterclockwise direction around the screw threads of the shaft, whereby to cause the collar to move axially and forwardly along the shaft. Accordingly, the upper and lower grip members can slide along the shaft to be uncoupled from one another and the end cap. More particularly, the teeth of the respective spline sets of the end cap and the grip members are moved out of interlocking engagement so that the elliptical grip members can now be rotated relative to one another around the shaft. Once the upper and lower grip members have been selectively positioned so that the golfer will be able to consistently grip his club in an optimum manner during play, the locking collar is rotated in a clockwise direction around the shaft. The collar then moves axially and rearwardly along the shaft, whereby the upper and lower grip members are once again coupled tightly together and to the end cap so that no further rotation of the grip members is possible. The golfer grasps the golf club in the traditional manner during play until a further adjustment of the grip assembly is desired.

DETAILED DESCRIPTION

Figure 1:
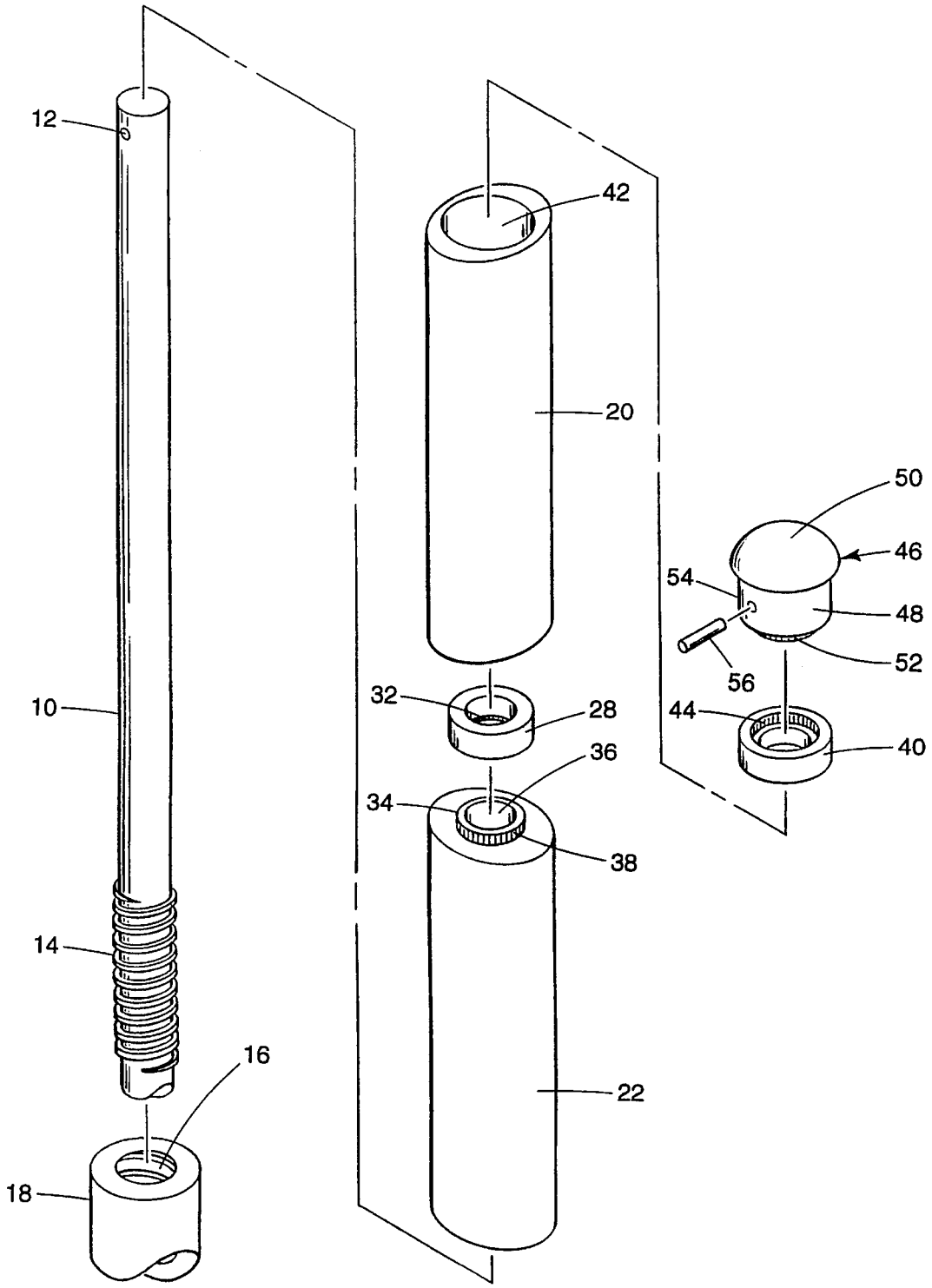
FIG. 1 is an exploded view of the segmented, variable position grip assembly for a golf club which forms the present invention.
Figure 6:
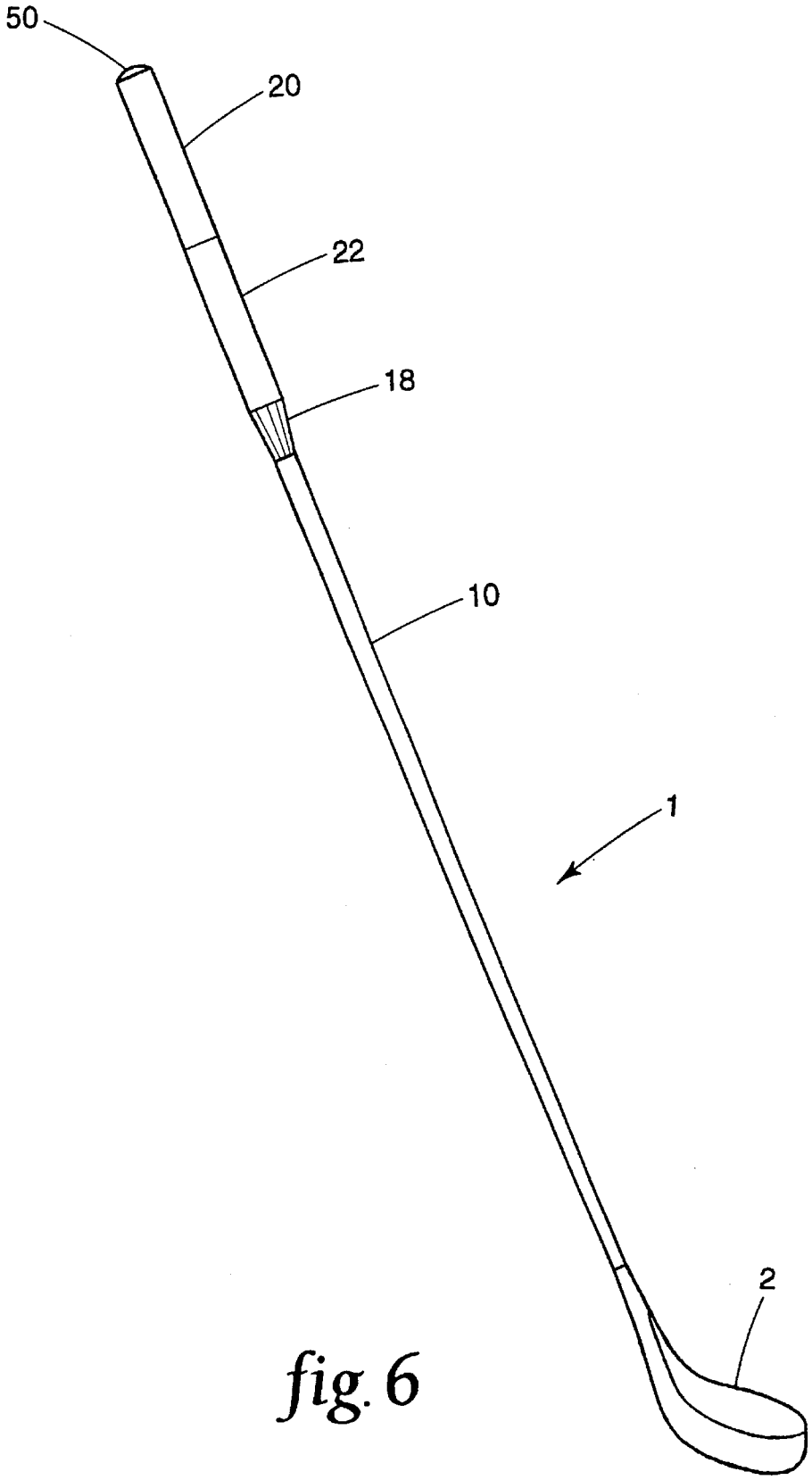
FIG. 6 is a perspective view of a golf club having the segmented, variable position grip of the present invention located at one end of the golf club shaft.

A golf club having the segmented, variable position grip assembly which forms the present invention is described in detail while referring to the drawings, where FIG. 1 shows an exploded view of the grip assembly. The golf club (designated 1 in FIG. 6) includes an elongated shaft 10 having a conventional wood or metal club head (designated 2 in FIG. 6) affixed to the front end of the shaft 10 and the grip assembly of FIG. 1 located at the opposite, rear end of shaft 10. The shaft 10 is an elongated cylindrical member typically manufactured from metal and having a longitudinally extending axis. A pin hole 12 extends laterally through the rear end of the shaft 10 and a series of screw threads 14 spirals around the shaft approximately ten inches below pin hole 12.

As will be explained in greater detail when referring to FIGS. 2 and 3, the screw threads 14 of shaft 10 are adapted to be mated to a corresponding set of screw threads 16 at the interior of a hollow locking collar 18. The locking collar 18 is a plastic, slightly tapered cylinder that surrounds and slides in opposite directions over the shaft 10 to either retain the grip assembly tightly coupled together and locked against the shaft 10 or permit the grip assembly to be uncoupled and displaced relative to the shaft.

The grip assembly of FIG. 1 includes an upper grip member 20 and a lower grip member 22. The upper and lower grip members 20 and 22 are preferably molded from lightweight plastic, although the material from which the grip members are manufactured is not to be considered a limitation of this invention. As is best shown in FIGS. 2 and 3, each of the upper and lower grip members 20 and 22 is covered with a soft (e.g. rubber) cushion surface 23 as is common to the grips of most golf clubs. Each grip member 20 and 22 has a hollow, cylindrical channel running longitudinally therethrough to accommodate the shaft 10. In this regard, and as an important aspect of this invention, the upper and lower grip members 20 and 22 are rotatable relative to one another around shaft 10.

As another important aspect, each of the upper and lower grip members 20 and 22 has a non-cylindrical cross-section. While it is preferable that the cross-sections of grip members 20 and 22 are elliptical in shape, the non-cylindrical cross-sections thereof may have any other suitable shape to suit the needs and comfort of the golfer depending upon the size and shape of his hands. Moreover, it is to be understood that the grip members 20 and 22 may have identical or differently shaped cross-sections with respect to one another. In the case of the present example, each of the upper and lower grip members 20 and 22 has an identical elliptical cross-section (best illustrated in FIG. 5).

Located between the upper and lower grip members 20 and 22 is a cylindrical metal insert 28. Insert 28 is hollow to accommodate the shaft 10 therethrough. In the assembled golf club configuration, the cylindrical insert 28 is seated and retained within a correspondingly shaped receptacle (designated 30 and best shown in FIGS. 2 and 3) formed in the front end of the upper grip member 20. When seated within its receptacle 30, the insert 28 will lie flush with the front end of grip member 20. A peripheral spline set 32 is formed around the hollow interior of the insert 28 and located at the front end thereof for an important purpose that will soon be described.

A cylindrical neck 34 that is manufactured from metal projects outwardly from the rear end of the lower grip member 22. The neck 34 is hollow to accommodate the shaft 10 therethrough. Neck 34 is seated and retained within a correspondingly shaped receptacle (designated 36 and best shown in FIGS. 2 and 3) formed in the rear end of the lower grip member 22. In the assembled golf club relationship, the insert 28 of upper grip member 20 and the neck 34 of lower grip member 22 are axially aligned with one another and coaxially aligned with respect to the longitudinal axis of the shaft 10.

A peripheral spline set 38 is formed around the exterior of the neck 34 projecting from lower grip member 22. The respective peripheral spline sets 32 and 38 of insert 28 and neck 34 are complementary to one another. That is to say, spline sets 32 and 38 are adapted to be mated to one another in the assembled golf club relationship (as best shown in FIG. 2) to prevent the rotation of the upper and lower grip members 20 and 22 relative to one another. By way of example, to enable the golfer to accurately adjust the grip assembly of his golf club, it is contemplated that the spline sets 32 and 38 will each contain sixty uniformly spaced teeth that can be moved into detachable interlocking engagement when the spline sets are mated together, whereby to couple upper grip member 20 to lower grip member 22.

Another hollow, cylindrical metal insert 40 (identical to the previously described insert 28) is, in the assembled golf club relationship, seated and retained within a correspondingly shaped receptacle (designated 42 in FIGS. 2 and 3) formed through the rear end of the upper grip member 20. More particularly, when it is seated within receptacle 42, the insert 40 will be spaced forwardly from the rear end of grip member 20. A peripheral spline set 44 (identical to the spline set 32 of insert 28) is formed around the hollow interior of the insert 40 and located at the rear end thereof.

A metal end cap 46 has a relatively narrow cylindrical body 48 and a relatively wide button head 50 coextensively connected to the rear end of body 48. A longitudinal channel extends through the body 48 of end cap 46 to receive and capture the rear end of the shaft 10 therewithin (best shown in FIGS. 2 and 3). A peripheral spline set 52 projects radially outwardly from and extends around the exterior of the front end of the body 48. In the assembled golf club relationship of FIGS. 2 and 3, the body 48 of end cap 46 is received within the receptacle 42 through the rear end of upper grip member 20 so as to be positioned in receptacle 42 immediately behind insert 40 with the button head 50 of end cap 46 lying flush against the rear end of upper grip member 20. Thus, as is also best shown in FIGS. 2 and 3, the body 48 of end cap 46 and the insert 40 of upper grip member 20 are axially aligned with one another and coaxially aligned with respect to the longitudinal axis of the shaft 10.

The spline set 52 of end cap 46 is complementary to the spline set 44 of the insert 40. In this regard, the (e.g. sixty) teeth of the peripheral spline sets 52 and 44 are uniformly spaced and adapted to be moved into detachable interlocking engagement when the spline sets are mated together, whereby to couple end cap 48 to upper grip member 20 and thereby prevent the rotation of the upper grip member 20 and the lower grip member 22 coupled thereto relative to the end cap 46.

A pin hole 54 extends laterally through the body 48 of end cap 46. In the assembled golf club relationship, the pin hole 12 through shaft 10 is axially aligned with the pin hole 54 through end cap 46. A short retaining pin 56 is located through the pin holes 12 and 54 to affix the end cap 46 to the rear end of the shaft 10 and thereby prevent the grip assembly from rotating around the shaft 10 when the upper and lower grip members 20 and 22 are coupled to one another and to the shaft by way of the end cap 46 in the manner shown in FIG. 2.

Figure 2:
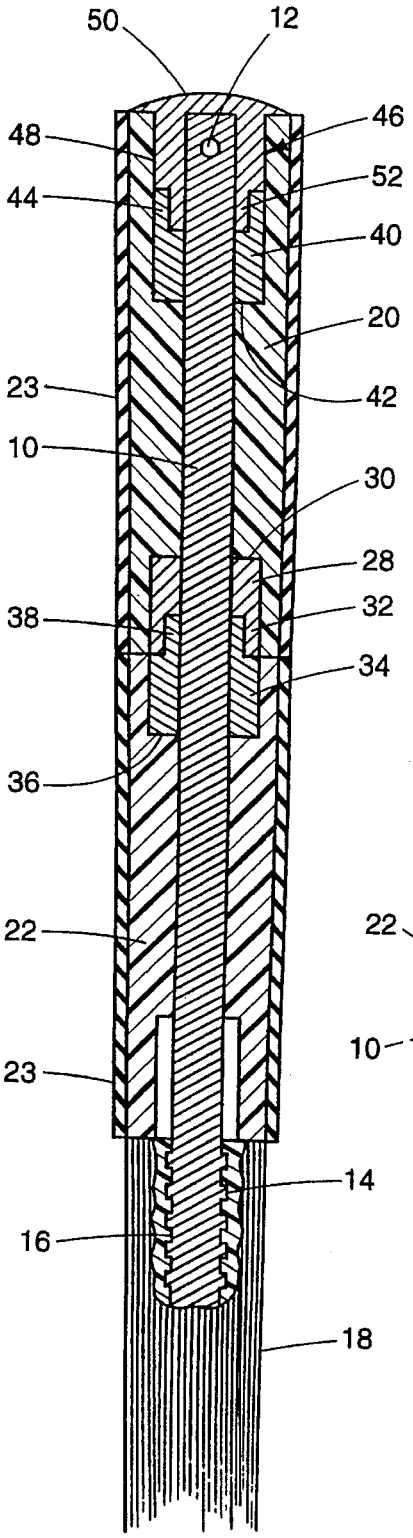
FIG. 2 is a cross-section of the grip assembly of FIG. 1 securely coupled together in the assembled golf club relationship and locked in surrounding engagement against the shaft of a golf club.
Figure 4:
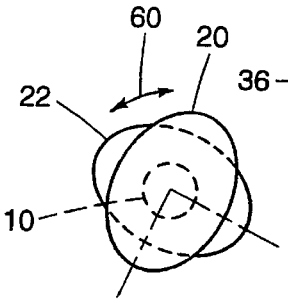
FIG. 4 is a diagrammatic illustration of the rotation relative to one another around the shaft of the golf club of upper and lower grip members which form the grip assembly of FIG. 1.
Figure 3:
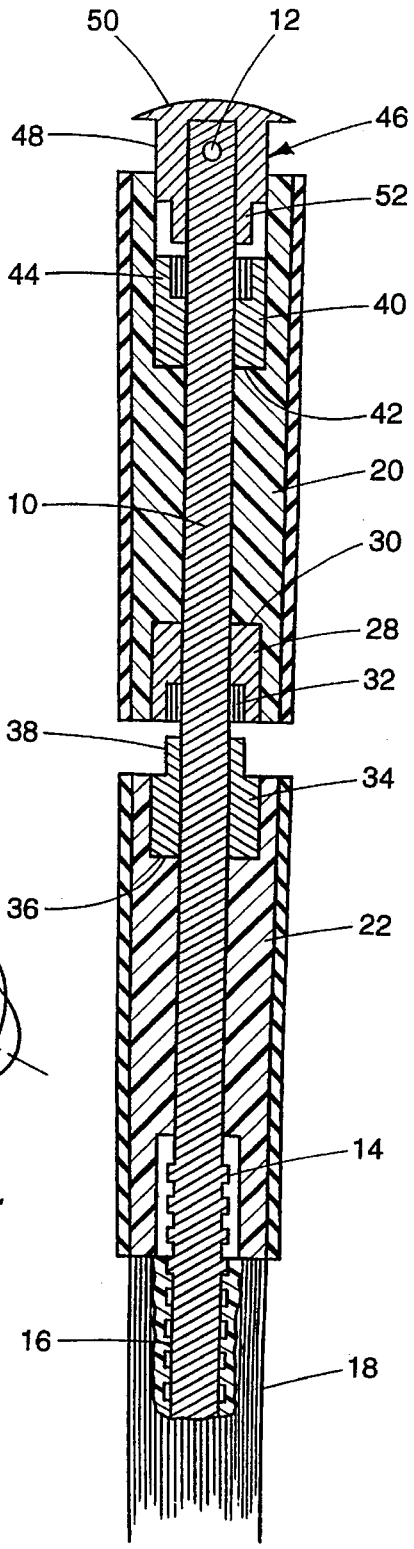
FIG. 3 is a cross-section of the grip assembly of FIG. 1 uncoupled and adapted to be rotated around the shaft of the golf club.

The operation of the segmented, variable position grip assembly of the golf club 1 (of FIG. 6) is now described while referring to FIGS. 2–4 of the drawings. FIG. 2 shows the grip assembly with the upper and lower grip members 20 and 22 tightly coupled to one another and to the shaft 10 so that the grip members 20 and 22 can not be rotated around the shaft. More particularly, the locking collar 18 is initially rotated in a clockwise direction around the screw threads 14 of the shaft 10 so that collar 18 slides axially and rearwardly along the shaft into engagement with the lower grip member 22. Accordingly the spline set 38 at the neck 34 of the lower grip member 22 is mated to the opposing spline set 32 of the insert 28 of the upper grip member 22, whereupon the upper and lower grip members 20 and 22 are coupled together. Moreover, the spline set 44 of the insert 40 of the upper grip member 20 is mated to the opposing spline set 52 at the body 48 of end cap 46, whereupon the grip members 20 and 22 are coupled to the end cap 46. As previously described, the end cap 46 is affixed to the shaft 10 by means of retaining pin 56. Therefore, it may be appreciated that in the assembled relationship of FIG. 2, the upper and lower grip members 20 and 22 can not be rotated around the shaft 10 inasmuch as the grip members are coupled to the shaft 10 by way of the end cap 46 and the shaft 10 is stationery relative to the golf club 1.

Referring to FIG. 4, the grip assembly is adjusted to suit the habits and needs of the golfer according to the playing conditions of the golf course. More particularly, the locking collar is now rotated in a counter-clockwise direction around the screw threads 14 of the shaft 10 so that the collar 18 slides axially and forwardly along the shaft in a direction away from the lower grip member 22. Accordingly, the upper and lower grip members 20 and 22 are free to slide along the shaft 10. The opposing spline sets 38 and 33 of lower grip member 22 and insert 28 are moved out of mating engagement, whereupon the upper and lower grip members 20 and 22 can now be uncoupled and separated from one another. Moreover, the opposing spline sets 44 and 52 of insert 40 and end cap 46 are moved out of mating engagement, whereupon the grip members 20 and 22 are uncoupled from each other and separated from the end cap 46.

At this time, the golfer may selectively rotate either one or both of the elliptical grip members 20 and 22 around the shaft 10 in the directions indicated by the reference arrows 60 of FIG. 4. In the example shown in FIG. 4, the upper and lower grip members 20 and 22 have been rotated relative to one another such that the major axes thereof form a 90 degree angle therebetween. Of course, the amount of rotation imparted to the elliptical grip members 20 and 22 around the shaft 10 is determined by the golfer to achieve a grip assembly which is both comfortable and positioned so as to produce an accurate golf shot.

Once the positions of the upper and lower grip members 20 and 22 have been selected to suit the needs of the golfer, the locking collar 18 is once again rotated in a clockwise direction around the shaft 10 so that the collar 18 slides along the shaft and towards the lower grip member 22. Accordingly, the upper and lower grip members 20 and 22 will once again be coupled to each other and to the shaft 10 by way of the end cap 46 in the same manner described while previously referring to FIG. 2 so as to prevent any additional rotation of the grip members away from the positions set by the golfer.

Figure 5:
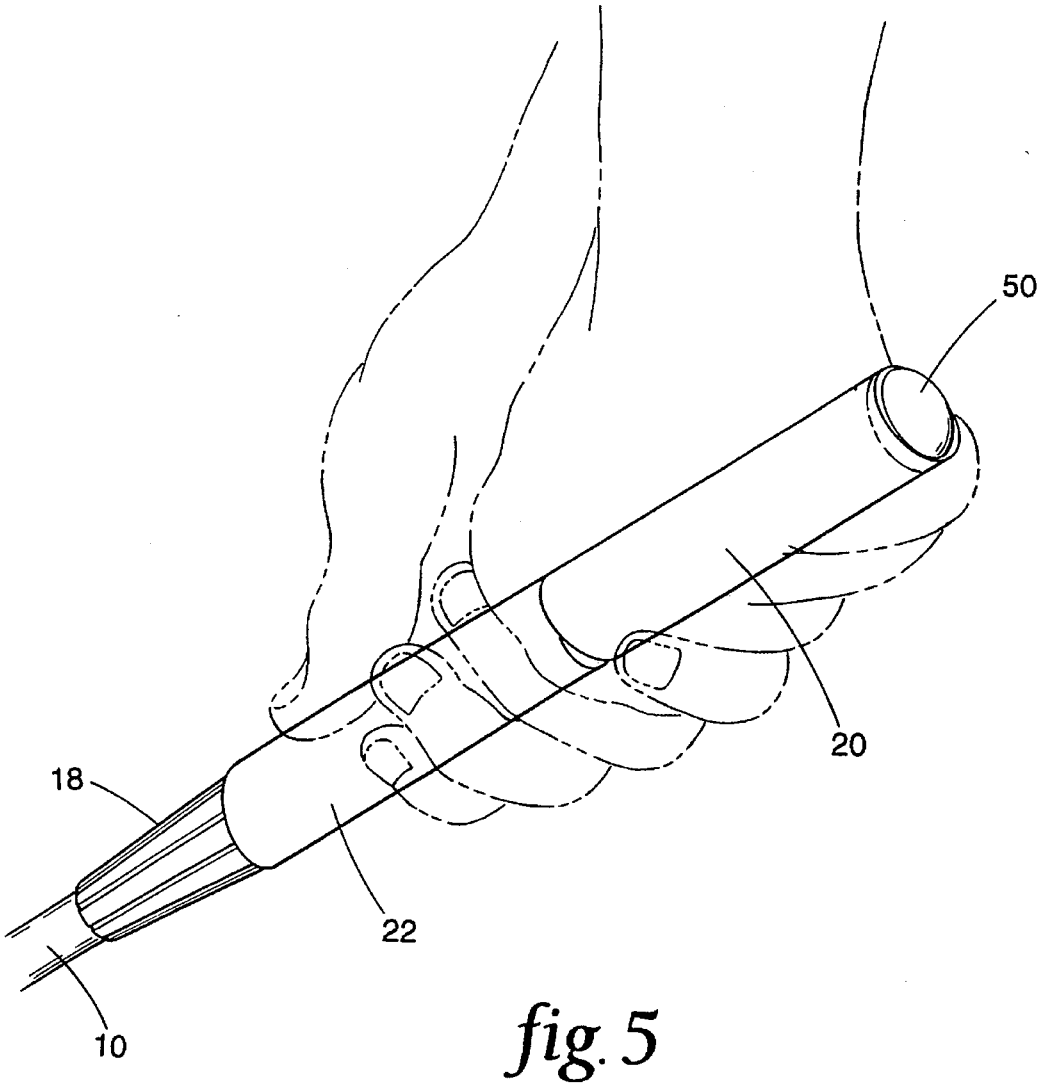
FIG. 5 shows the golfer grasping the grip assembly of his golf club after the upper and lower grip members have been rotated around the shaft.

As shown in FIG. 5 of the drawings, the golfer may grasp the golf club with his hands wrapped around the upper and lower grip members 20 and 22 that have been selectively rotated to and locked in the positions to suit the golfer's needs. In this regard, the golfer now grasps his golf club (designated 1 in FIG. 6) in the traditional manner during play until a further adjustment of the grip assembly is desired as described above. However, and by virtue of the present invention, the golfer will be able to hold on to the grip assembly so that the club can be played in a consistent and optimal manner, whereby the club head will strike the golf ball at the same angle during successive strokes.

Although a preferred embodiment of this invention has been shown and described, various modifications and changes may be made without departing from the true spirit and scope thereof.

Having thus set forth the preferred embodiment, what is claimed is:

1. A golf club comprising a cylindrical shaft including a longitudinally extending axis and first and second ends, a club head located at the first end of said shaft, and a grip surrounding the second end of said shaft, said grip having an upper grip member and a lower grip member, each of said upper and lower grip members adapted to be rotated relative to one another around said shaft, and means by which to releasably lock said upper and lower grip members at the respective positions to which they have been rotated around said shaft.

2. The golf club recited in claim 1, wherein each of said upper and lower grip members includes a body surrounding said shaft and having non-cylindrical cross-section.

3. The golf club recited in claim 2, wherein the body of each of said upper and lower grip members has an elliptical cross-section.

4. The golf club recited in claim 1, further comprising means to couple said upper and lower grip members to each other and to said shaft.

5. The golf club recited in claim 4, wherein each of said upper and lower grip members has a front end and a rear end, the front end of said upper grip member opposing the rear end of said lower grip member, said golf club further comprising a first set of spline teeth at the front end of said upper grip member and a second set of spline teeth at the rear end of said lower grip member, said first and second sets of spline teeth moving into detachable interlocking engagement with one another to couple said upper and lower grip members to each other.

6. The golf club recited in claim 5, further comprising a first insert surrounding said shaft and having said first set of spline teeth and a first receptacle formed in the front end of said upper grip member in which to receive said first insert, and a second insert surrounding said shaft and having said second set of spline teeth and a second receptacle formed in the rear end of said lower grip member in which to receive said second insert, said first and second inserts being axially aligned with respect to one another along said shaft so that said first and second sets of spline teeth are moved into detachable interlocking engagement.

7. The golf club recited in claim 4, further comprising an end cap affixed to said shaft and having a first set of spline teeth, said upper grip member having a second set of spline teeth aligned opposite the first set of spline teeth of said end cap, said first and second sets of spline teeth moving into detachable interlocking engagement with one another to couple said end cap to said upper grip member and said upper grip member to said shaft by way of said end cap that is affixed to said shaft.

8. The golf club recited in claim 7, further comprising an insert surrounding said shaft and having said second set of spline teeth, and a receptacle formed in said upper grip member in which to receive said insert and said end cap in axial alignment with respect to one another along said shaft so that said first and second sets of spline teeth are moved into detachable interlocking engagement within said receptacle.

9. The golf club recited in claim 7, further comprising fastening means extending through said end cap and into said shaft so that said end cap is affixed to said shaft.

10. The golf club recited in claim 9, wherein said end cap surrounds the second end of said shaft.

11. The golf club recited in claim 1, wherein the means by which to releasably lock said upper and lower grip members at the respective positions to which they have been rotated around said shaft includes a locking collar surrounding said shaft at a location between said grip and said club head, said locking collar adapted to slide over said shaft and into engagement with said grip to prevent the rotation of said upper and lower grip members around said shaft.

12. The golf club recited in claim 11, wherein said shaft has a first set of screw threads located between the first and second ends thereof and said locking collar has a second set of screw threads adapted to be mated to said first set of screw threads to lock said locking collar in mating engagement against said grip and thereby prevent the rotation of said upper and lower grip members around said shaft.

13. A golf club comprising a cylindrical shaft including a longitudinally extending axis and first and second ends, a club head located at the first end of said shaft, and a grip surrounding the second end of said shaft, said grip having an upper grip member and a lower grip member, each of said upper and lower grip members surrounding said shaft and adapted to be rotated relative to one another around said shaft, at least one of said upper and lower grip members having a non-cylindrical cross-section, means by which to releasably lock said upper and lower grip members at their respective positions to which they have been rotated with regard to said shaft, and means by which to prevent said upper and lower grip members from rotating relative to one another.

14. The golf club recited in claim 13, wherein the at least one of said upper and lower grip members having a non-cylindrical cross-section has an elliptical cross-section.

15. The golf club recited in claim 13, wherein the means by which to releasably lock said upper and lower grip members at their respective positions to which they have been rotated with regard to said shaft includes a locking collar surrounding said shaft at a location between said grip and said club head and adapted to slide over said shaft and into engagement with said grip to prevent the rotation around said shaft of said upper and lower grip members.

16. The golf club recited in claim 13, wherein said upper and lower grip members are arranged in opposing axial alignment with one another and said means by which to prevent said upper and lower grip members from rotating relative to one another include first and second sets of spline teeth respectively formed at opposing ends of said upper and lower grip members, said first and second sets of spline teeth moving into detachable interlocking engagement to couple said grip members together.

17. A golf club comprising a cylindrical shaft including a longitudinally extending axis and first and second ends, a club head located at the first end of said shaft, and a grip surrounding the second end of said shaft, said grip having an upper grip member and a lower grip member, each of said upper and lower grip members surrounding said shaft in opposing axial alignment with one another, at least one of said upper and lower grip members having a non-cylindrical cross-section and adapted to be rotated around said shaft relative to the other one of said grip members, and first and second sets of spline teeth respectively formed at opposing ends of said upper and lower grip members, said first and second sets of spline teeth moving into detachable interlocking engagement so as to couple said upper and lower grip members together.

18. The golf club recited in claim 17, further comprising means by which to releasably lock the rotatable one of said upper and lower grip members at the position to which it is rotated around said shaft.

19. The golf club recited in claim 17, further comprising a locking collar surrounding said shaft at a location between said grip and said club head and adapted to slide over said shaft into engagement with said grip to prevent the rotation around said shaft of the rotatable one of said upper and lower grip members relative to the other one of said grip members.

20. The golf club recited in claim 17, wherein each of said upper and lower grip members has a non-cylindrical cross-section and each of said upper and lower grip members is adapted to be rotated around said shaft relative to the other one of said grip members.

* * * * *